US011408208B2

(12) United States Patent
Hunt et al.

(10) Patent No.: US 11,408,208 B2
(45) Date of Patent: Aug. 9, 2022

(54) MOTOR VEHICLE LATCHING SYSTEM WITH PYROTECHNIC BLOCKING DEVICE

(71) Applicant: Kiekert AG, Heiligenhaus (DE)

(72) Inventors: Robert J. Hunt, Davisburg, MI (US); Scott Brown, Livonia, MI (US); Octavian Cimpean, Rochester Hills, MI (US); Jeff Duncan, Howell, MI (US)

(73) Assignee: Kiekert AG, Heiligenhaus (DE)

( * ) Notice: Subject to any disclaimer, the term of this patent is extended or adjusted under 35 U.S.C. 154(b) by 622 days.

(21) Appl. No.: 16/022,800

(22) Filed: Jun. 29, 2018

(65) Prior Publication Data

US 2019/0003211 A1 Jan. 3, 2019

Related U.S. Application Data

(60) Provisional application No. 62/527,976, filed on Jun. 30, 2017.

(51) Int. Cl.

| | |
|---|---|
| ***E05B 77/04*** | (2014.01) |
| ***E05B 51/02*** | (2006.01) |
| ***E05B 77/12*** | (2014.01) |
| *E05B 77/06* | (2014.01) |

(52) U.S. Cl.

CPC ..... *E05B 77/04* (2013.01); *E05B 51/023* (2013.01); *E05B 77/12* (2013.01); *E05B 77/06* (2013.01)

(58) Field of Classification Search

CPC ..... E05B 51/023; E05B 77/12; E05B 77/04

See application file for complete search history.

(56) References Cited

U.S. PATENT DOCUMENTS

2014/0175808 A1* 6/2014 Faust ..... E05B 77/04 292/95

FOREIGN PATENT DOCUMENTS

| | | | | |
|---|---|---|---|---|
| DE | 102004008048 A1 * | 9/2005 | ..... | E05B 81/04 |
| DE | 102009038612 A1 * | 3/2011 | ..... | E05B 77/06 |
| DE | 102011116424 A1 * | 4/2013 | ..... | E05B 77/04 |
| DE | 102012020696 A1 | 5/2013 | | |
| EP | 2096007 A1 * | 9/2009 | ..... | E05B 51/023 |
| JP | 2003020485 A | 1/2003 | | |

OTHER PUBLICATIONS

International Search Report dated Sep. 26, 2018, for International Patent Application No. PCT/IB2018/000647.

International Preliminary Report on Patentability dated Dec. 31, 2019, for International Patent Application No. PCT/IB2018/000647.

* cited by examiner

*Primary Examiner* — Kristina R Fulton

*Assistant Examiner* — James E Ignaczewski

(74) *Attorney, Agent, or Firm* — Renner, Otto, Boisselle & Sklar, LLP

(57) ABSTRACT

A latching device with a blocking device that is capable of preventing unintentional opening of a door or a flap in the case of a crash. The blocking device includes a pyrotechnic gas generator. The pyrotechnic gas generator triggers in the case of a crash and moves a blocking element into a blocking position which prevents opening of the locking mechanism of the latching device.

20 Claims, 3 Drawing Sheets

MOTOR VEHICLE LATCHING SYSTEM WITH PYROTECHNIC BLOCKING DEVICE

RELATED APPLICATION DATA

This application claims the benefit of U.S. Provisional Application No. 62/527,976 filed Jun. 30, 2017, which is hereby incorporated by reference.

FIELD OF THE INVENTION

The invention relates to a latching system for a motor vehicle with a blocking device. The blocking device is triggered by a crash and then counteracts unscheduled opening.

Such a latching system demonstrates a locking mechanism comprising a catch and at least a pawl for ratcheting of the catch in at least one ratchet position and optionally a blocking lever for blocking of the pawl in its ratchet position. The purpose of an activation device of such a latching system is to open the door or flap and therefore enable unratcheting or opening of the locking mechanism. By activating the activation device the pawl is moved out of its ratchet position and, if necessary, the blocking lever is previously moved out of its blocking position and the locking mechanism finally opened. The door or flap can then be opened.

The activation device normally possesses a triggering lever which is activated to open the locking mechanism. Such a triggering lever is connected to an activation lever, for example. The activation lever can be an external handle or an internal handle of a relevant door or flap. If such an activation lever is activated, the triggering lever is pivoted to unratchet the locking mechanism and open the latch as a result. Alternatively or additionally, an electrical drive can be present to activate the triggering lever with the aid of the electrical drive and thus to open the locking mechanism.

In the event of an accident or a vehicle collision, also known as a crash hereafter, very high acceleration forces usually occur suddenly which can be a multiple of gravitational acceleration. Thus the relevant latch, including the lever system, such as the activation lever, is exposed to considerable forces which can lead to an unwanted opening of the locking mechanism and consequently an unwanted opening of the pertaining door or flap. In the case of a crash, the activation lever, i.e. an internal door handle or an external door handle, can also be activated in an unscheduled manner which would also lead to opening of the locking mechanism and concomitantly an opening of a door or a flap.

BACKGROUND

As a result of the scenarios described considerable risks result for the vehicle user. Because an unintentionally opened motor vehicle door can no longer provide the safety devices present in it, such as a lateral airbag or lateral impact protection for the protection of the vehicle occupants. Thus, blocking devices or mechanisms are provided for which prevent opening of a door or a flap when excessively high acceleration forces arise, as in the case of a crash. A blocking device capable of performing this is known from brochures EP 1 375 794 A2, EP 1 518 983 A2, DE OS 1653 964, DE OS 28 41 546, WO 2014/019960 A2 or WO 2012/013182 A2. In the solutions known from the state of the art, blocking devices may fail in the case of a crash due to deformities, canting and/or unfavorably induced forces.

Gas generators are known from the state of the art which trigger in the case of a crash. Such gas generators are used in airbags. For example, it is known from brochures DE 10 2015 122 579 A1, WO 15139678 A1, DE 10 2013 022 059 A1, DE 10 2013 109 051 A1 to use pyrotechnic gas generators or pyrotechnic actuators for other purposes too in the automotive field. The brochure DE 10 2013 022 059 A1 teaches the pivoting of a pawl of a motor vehicle latching device with the aid of a pyrotechnic element in the case of a crash.

SUMMARY

The invention provides an advantageous latching system for a motor vehicle with a blocking device which is capable of preventing unintentional opening of a door or flap in a crash with particular reliability.

In accordance with the invention, a latching system comprises a locking mechanism with a blocking device that includes a gas generator and in particular a pyrotechnic gas generator, whereby the gas generator is arranged in such a way that it can be triggered by a crash and thus moves a blocking element into a blocking position which prevents opening of the locking mechanism.

Unless stated otherwise hereinafter, the activation device can comprise the characteristics stated above which are known from the state of the art individually or in any combination.

More particularly, a latching system according to the invention comprises a blocking device with a gas generator and in particular a pyrotechnic gas generator which can be triggered by a crash. The gas generator can therefore be triggered by very great accelerations as can occur in the case of a crash. The gas generator on the contrary is not triggered by accelerations which occur in normal conditions. The blocking element is moved into a blocking position by the triggering of the gas generator. Opening of the locking mechanism is prevented in the blocking position.

A gas generator is used in the present invention to move the blocking element of the blocking device into a blocking position with the necessary speed and safety, for example, in order to thus be able to reliably and quickly prevent a latching system opening in an unscheduled manner in the case of a crash. In particular, compared to the solutions known from the state of the art, the failure of a blocking device due to deformities, canting and/or due to unfavorably introduced forces is prevented in an improved manner.

In an advantageous design, the blocking device is created in such a way that it is capable of preventing unscheduled opening of the latching system in the case of a crash as known from the state of the art, even without triggering of the gas generator. As a result of the gas generator, the proper functioning of the blocking device is then only therefore supported. In a further improved manner, it is thus ensured that the latching system cannot open in an unscheduled manner in the case of a crash.

The invention is explained in further detail hereafter on the basis of examples.

BRIEF DESCRIPTION OF THE DRAWINGS

The following are shown.

DETAILED DESCRIPTION

Figure 1:
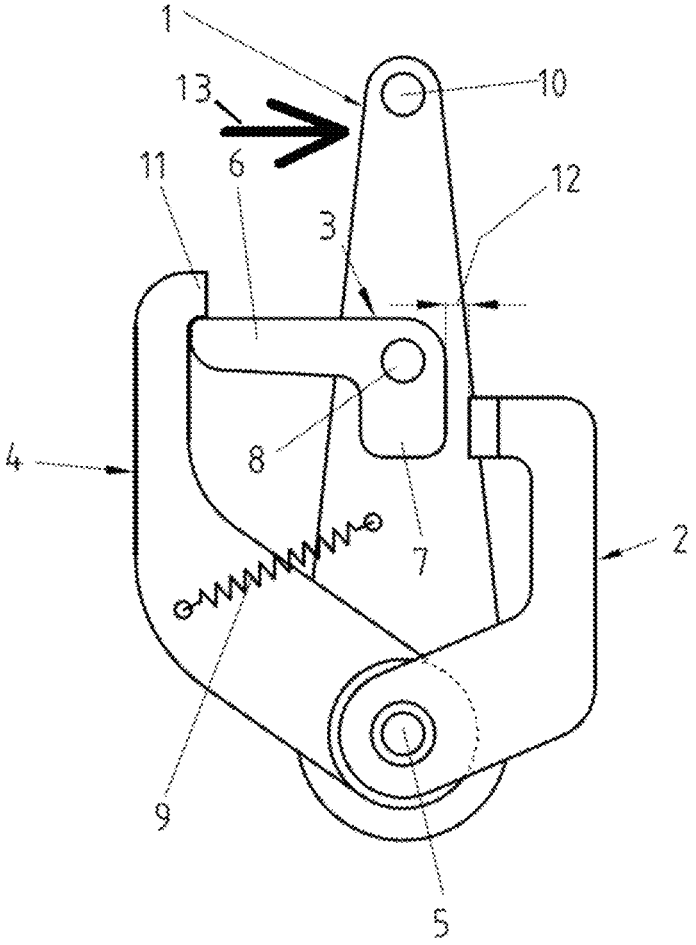
FIG. 1: Activation device of a latching system with a blocking device.

FIG. 1 shows an activation device of a motor vehicle latching system. The activation device encompasses an activation lever 1 and an inertia lever 4 which are connected via a spring 9 in such a way that the activation lever 1 and the inertia lever 4 move together like a rigid body in the case of low acceleration of the activation lever, but in the case of excessively high acceleration a distance increases between the activation lever 1 and the inertia lever 4. FIG. 1 shows how this acceleration-dependent behavior can be used to enable a non-illustrated locking mechanism to only open with sufficiently low acceleration of the activation lever 1. This is enabled by a pawl 3 which is situated in a starting position in the case of FIG. 1 in which the activation device is not activated.

The activation lever 1 is pivotably attached by an axis 5 on a non-illustrated plate or a housing of the activation device. The plate or the housing can simultaneously be part of a connected, non-illustrated latch which comprises a locking mechanism consisting of a catch and a pawl. The activation lever 1 can be connected to a non-illustrated handle via a non-illustrated Bowden cable, a rope or via a rod assembly. The handle can be an external handle or an internal handle of a door or flap of a motor vehicle.

The free end of the elongated activation lever 1 demonstrates an attachment option 10 for the rope, rod assembly or Bowden cable 3, for example in the form of a hole or an eyelet. If the stated handle is activated, the activation lever 1 is pivoted with the aid of the rope, the rod assembly or the Bowden cable 3 in a clockwise direction around the axis 5.

The axis 5 furthermore pivotably accommodates an arch-shaped triggering lever 2 and an arch-shaped inertia lever 4. The pawl 3 is pivotably attached on the activation lever 1 by an axis 8. This pawl 3 is located approximately at the height of the free ends of the triggering lever 2 and the inertia lever 4. In the non-activated state shown the inertia lever 4 lies in a pre-tensioned manner on the longer and slimmer arm 6 or its free end of the pawl 3. The pre-tensioned spring 9 which is attached to the inertia lever 4 at one end and to the activation lever 1 at the other end is responsible for the pre-tensioning. The activation lever 1 and the inertia lever 4 are therefore connected in a pre-tensioned manner by a spring 9.

The inertia lever 4 encompasses an angular end 11 by means of which the pawl 3 in the shown non-activated state is prevented from pivoting or rotating in the clockwise direction and thus leaving its starting position. The section which is angled at the end of the angular end is shorter than the distance between the broader and shorter arm 7 of the pawl 3 and the triggering lever 2.

The pawl 3 encompasses a short, broad arm 7 which includes a right angle with the long arm 6. The free end of the short arm 7 is adjacent to the free end of the arm shown of the triggering lever 2. However, in the non-activated state, as shown, it demonstrates a distance 12 to this end.

If the stated handle is activated, the activation lever 1 thus pivots in a clockwise direction. With normal acceleration, the inertia lever 4 and the activation lever 1 act together like a rigid body due to the connection via the spring 9. The consequence of this is that during an activation movement the pawl 3 is held by the angular end 11 in the starting position in such a way that the short arm 7 finally reaches the free end of the shown arm of the triggering lever 2 and the triggering lever 2 is then also pivoted in a clockwise direction. This pivoting opens a locking mechanism by moving a pawl of the locking mechanism out of its ratchet position. The catch of the locking mechanism is thus released and can then pivot in the opening direction. A locking bolt held by the catch previously can leave the locking mechanism in order to thus be able to open a pertaining door or flap.

In the case of excessive acceleration, the activation lever 1 and the inertia lever 4 do not behave like a rigid body due to the spring connection. The distance between the angular end 11 and the activation lever 1 increases, whereby the pawl 3 or the free end of the arm 6 is moved away from the angular end 11. The pawl 3 can now pivot in a clockwise direction and leave its starting position. This happens as soon as the short arm 7 then reaches the free end of the arm of the triggering lever 2. As the arm 7 is shorter than the arm 6, the free end of the arm 6 is moved out of the engagement area of the angular end 11 at relatively high speed. The triggering lever 2 is not pivoted. Instead, the pawl 3 glides away via the triggering lever 2. A locking mechanism is thus not opened at high acceleration.

In order to ensure in a crash that the activation lever only performs an opening movement with little acceleration due to unfavorably introduced forces, there is a pyrotechnic gas generator depicted by an arrow which triggers in a crash and then accelerates the activation lever 1 in the direction of the arrow. It is thus ensured that the activation lever is accelerated with sufficiently high speed. Consequently, unscheduled opening of the locking mechanism cannot take place.

Overall, unscheduled opening of a pertaining locking mechanism is thus especially reliably prevented in the case of a crash and blocked for this purpose. The activation device shown in FIG. 1 therefore comprises a blocking device according to the claim with a pyrotechnic gas generator.

Figure 2:
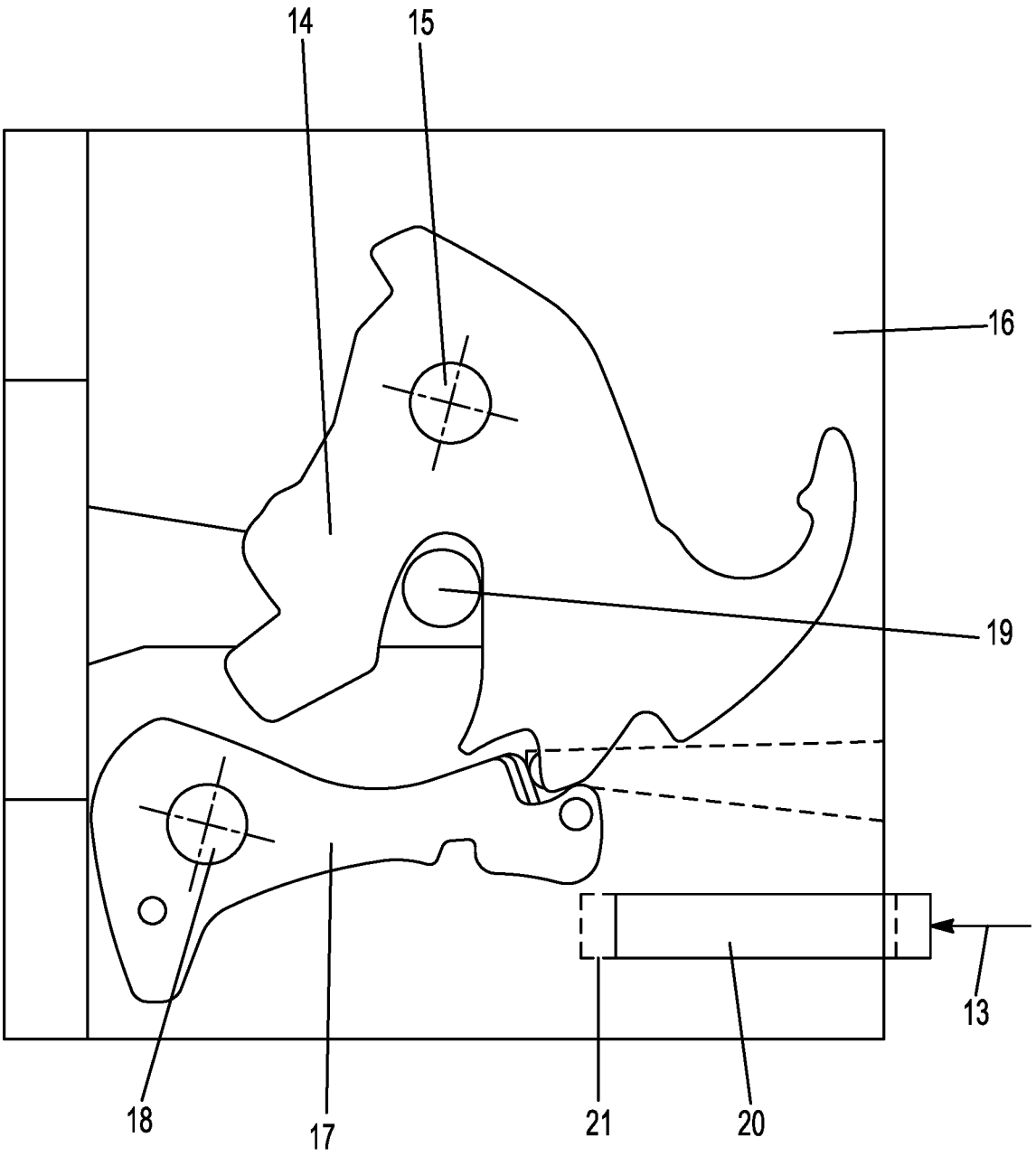
FIG. 2: Locking mechanism of a latching system with a blocking device.

FIG. 2 shows a locking mechanism with a catch 14 which is pivotably attached to a latch case 16 by means of an axis 15. The catch 1 is ratcheted by a pawl 17. The pawl 17 is pivotably attached to the latch case 16 by means of an axis 18. If the pawl 17 is pivoted around its axis 18 in a clockwise direction, the pawl 17 thus leaves its ratchet position. The catch 14 can then pivot in a clockwise direction around its axis 18 in the direction of the opening position. If the catch 14 has reached its opening position, the locking bolt 19 can thus leave the locking mechanism. A door or flap connected to the locking bolt 19 can be opened.

There is a movably accommodated, in particular a bolt-shaped blocking element 20, which is located in a non-blocking position. As depicted by dotted lines, the blocking element 20 can be moved into a blocking position 21. In the blocking position 21 the blocking element 20 prevents the pawl 17 being able to leave its ratchet position. The movement of the blocking element 20 into its blocking position 21 can occur with the aid of a pyrotechnic gas generator 13. If the pyrotechnic gas generator 13 is triggered in a crash, it thus moves the blocking element 20 into its blocking position 21. This thus prevents the locking mechanism from opening in an unscheduled manner in the case of a crash.

The blocking element 20 can also be arranged and set up in such a way that this can be moved in the case of a crash also without the pyrotechnic gas generator 13 into its blocking position 21 as soon as relevant forces impact on the blocking element 20. In order to attain this, the blocking element can protrude in respect of a locking mechanism of the latching device in order to be able to move into its blocking position, for example, by deformation of an adjacent chassis.

It is also possible that the blocking element 20 is located in a plane above the pawl 17 in its non-blocking starting position. By means of the pyrotechnic gas generator 13, the pawl is shifted into the plane of the pawl 17 in the case of a crash and thus moved into its blocking position.

Figure 3:
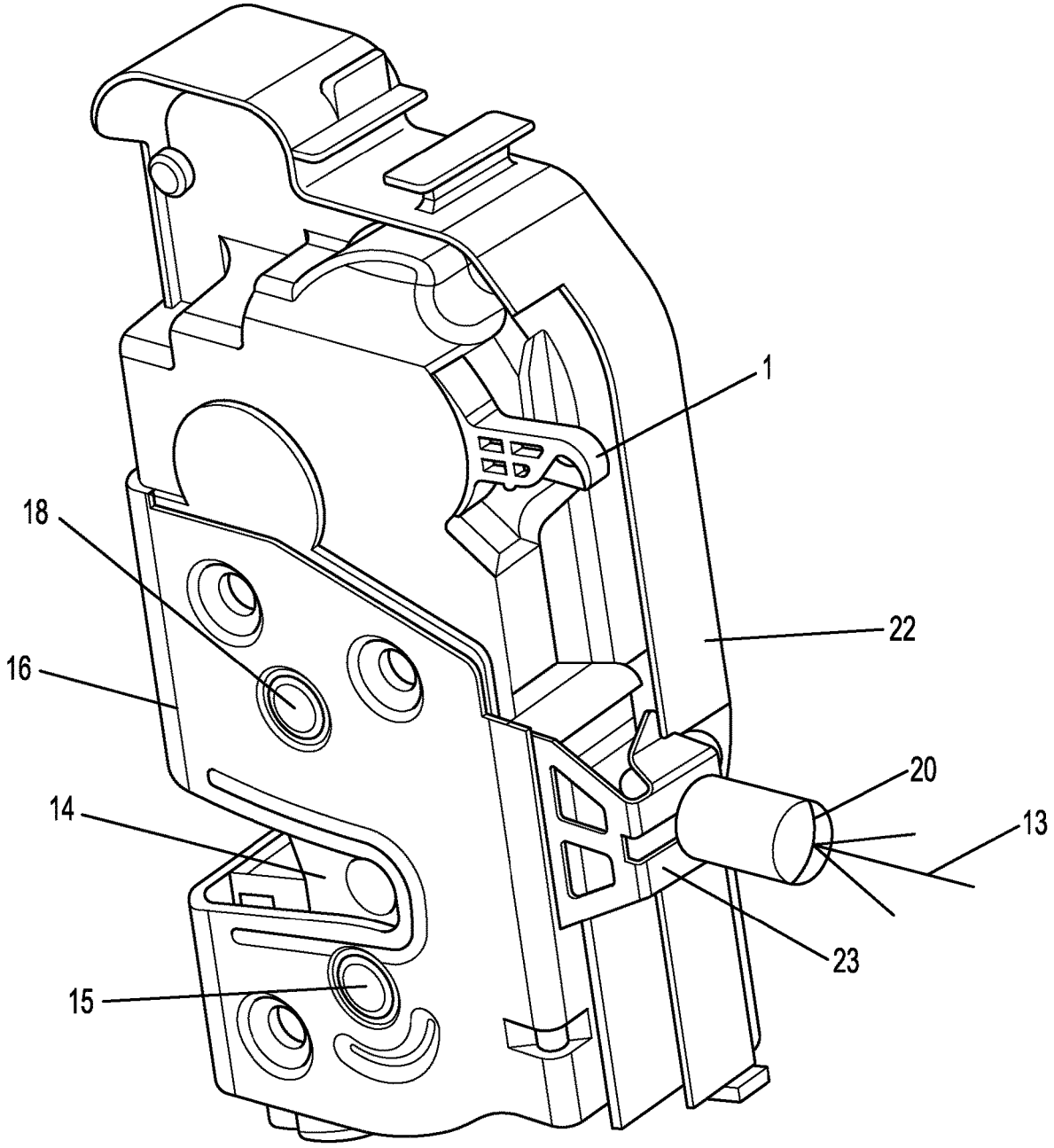
FIG. 3: Latching system with blocking device.

FIG. 3 shows an execution form with a bolt-shaped blocking element 20 which protrudes outwards in respect of a latch housing 22 and which is held in its starting position by a rib-shaped plastic, right-angled and therefore breakable retaining element 23.

The triggered pyrotechnic gas generator 13 acts on this blocking element 20 in such a way in the case of a crash that the blocking element 20 is moved from its non-blocking starting position shown in FIG. 3 into its blocking position. The retaining element 23 snaps in a relevant design. Consequently, the blocking element 20 is not moved back into its starting position. However, it is also conceivable that the retaining element 23 is made of metal, for example, and does not necessarily need to snap in the case of a crash, even if it is rib-shaped as illustrated.

The retaining element can thus be created in such a way that the blocking element 20 can be moved along a slit from one plane above a pawl into the plane of the pawl in order to thus block the pawl.

However, the locking mechanism can also encompass a blocking lever which blocks the pawl in its ratchet position if the blocking lever is located in its blocking position. The blocking element 20 can then block the blocking lever in its blocking position in such a way that it cannot leave its blocking position. It is thus attained that the locking mechanism cannot open in an unscheduled manner in the case of a crash.

REFERENCE SIGN LIST

1: Activation lever
2: Triggering lever
3: Pawl
4: Inertia lever
5: Axis
6: Long arm of the pawl
7: Short arm of the pawl
8: Axis of the pawl
9: Spring
10: Eyelet
11: Angular end
12: Distance
13: Pyrotechnic gas generator
14: Catch
15: Catch axis
16: Latch case
17: Pawl
18: Axis of the pawl
19: Locking bolt of a door or a flap
20: Blocking element
21: Blocking position of the blocking element
22: Latch housing
23: Retaining element

What is claimed is:

1. A latching system for a motor vehicle comprising:

a locking mechanism including a catch and a pawl rotatable between an open position in which the pawl is disengaged from the catch for opening the locking mechanism and a ratchet position in which the pawl engages the catch to ratchet the catch so that the locking mechanism is closed; and a blocking device including a gas generator arranged such that the gas generator can be triggered by a crash, the gas generator being configured upon being triggered to move a blocking element of the blocking device into a blocking position which prevents opening of the locking mechanism by engaging the pawl to block the pawl from rotating out of the ratchet position, wherein prior to the gas generator being triggered and during movement of the blocking element to the blocking position after the gas generator is triggered, the blocking element is in non-contact with the pawl and the pawl is in one ratchet position, and wherein when the blocking element reaches the blocking position, the blocking element directly contacts the pawl to retain the pawl in the one ratchet position.

2. The latching system according to claim 1, wherein the blocking element is bolt-shaped.

3. The latching system according to claim 1, wherein a retaining element holds the blocking element in a non-blocking starting position, whereby the blocking element can be moved into the blocking position by the gas generator.

4. The latching system according to claim 3, wherein the retaining element is rib-shaped.

5. The latching system according to claim 4, wherein the retaining element is made of metal and/or plastic.

6. The latching system according to claim 5, wherein the retaining element is angled.

7. The latching system according to claim 1, wherein the retaining element is made of metal and/or plastic.

8. The latching system according to claim 7, wherein the retaining element is angled.

9. The latching system according to claim 3, wherein the retaining element is made of metal and/or plastic.

10. The latching system according to claim 9, wherein the blocking element protrudes outwards in respect of a latch housing.

11. The latching system according to claim 8, wherein the blocking element protrudes outwards in respect of a latch housing.

12. The latching system according to claim 7, wherein the blocking element protrudes outwards in respect of a latch housing.

13. The latching system according to claim 6, wherein the blocking element protrudes outwards in respect of a latch housing.

14. The latching system according to claim 5, wherein the blocking element protrudes outwards in respect of a latch housing.

15. The latching system according to claim 4, wherein the blocking element protrudes outwards in respect of a latch housing.

16. The latching system according to claim 3, wherein the blocking element protrudes outwards in respect of a latch housing.

17. The latching system according to claim 2, wherein the blocking element protrudes outwards in respect of a latch housing.

18. The latching system according to claim 1, wherein the gas generator is a pyrotechnic gas generator.

19. The latching system according to claim 3, wherein the retaining element is breakable to enable the blocking element to move from the non-blocking starting position to the blocking position by the gas generator.

20. A latching system for a motor vehicle comprising:

a locking mechanism including a catch and a pawl movable between an open position for opening the locking mechanism and a ratchet position in which the locking mechanism is closed;

a blocking device including a gas generator arranged such that the gas generator can be triggered by a crash, the gas generator being configured upon being triggered to move a blocking element of the blocking device into a blocking position which prevents opening of the locking mechanism by engaging the pawl to block the pawl from rotating out of the ratchet position; and a retaining element that holds the blocking element in a non-blocking starting position in which the blocking element protrudes from a latch housing in which the locking mechanism is arranged, wherein the retaining element is configured to be attached to the latch housing when the blocking element is in the non-blocking starting position, wherein prior to the gas generator being triggered and during movement of the blocking element to the blocking position after the gas generator is triggered, the blocking element is in non-contact with the pawl and the pawl is in one ratchet position, and wherein when the blocking element reaches the blocking position, the blocking element directly contacts the pawl to retain the pawl in the one ratchet position.

* * * * *